US005382221A

United States Patent [19]

Hsu et al.

[11] Patent Number: 5,382,221

[45] Date of Patent: Jan. 17, 1995

[54] AUTOMATIC MASSAGER

[76] Inventors: Chi-Hsueh Hsu; Chih-Yes Shyu, both of 4F, No. 144, Chu-Lin Road, Yung-Ho Shih, Taipei Hsien, Taiwan, Prov. of China

[21] Appl. No.: 63,088

[22] Filed: May 18, 1993

[51] Int. Cl.[6] ..... A61H 7/00

[52] U.S. Cl. ..... 601/114; 601/136; 601/95; 15/21.1

[58] Field of Search ..... 601/112–114, 601/136–138, 95, 84; 4/606; 15/21.1, 88.2

[56] References Cited

U.S. PATENT DOCUMENTS

| | | | |
|---|---|---|---|
| 1,609,796 | 12/1926 | Cheney | 15/21.1 X |
| 2,007,073 | 7/1935 | Clarke | 15/49.1 |
| 2,142,933 | 1/1939 | Bickford | 15/49.1 X |
| 2,730,737 | 1/1956 | Herman | 15/88.2 |
| 3,078,484 | 2/1963 | Briggs | 15/21.1 |
| 3,478,369 | 11/1969 | Ensley | 601/136 X |
| 3,699,602 | 10/1972 | Cameron | 601/114 X |
| 4,955,101 | 9/1990 | King | 601/138 X |

FOREIGN PATENT DOCUMENTS

| | | | |
|---|---|---|---|
| 2347001 | 4/1977 | France | 4/606 |
| 2181043 | 4/1987 | United Kingdom | 15/21.1 |

*Primary Examiner*—Robert A. Hafer
*Assistant Examiner*—Brian E. Hanlon
*Attorney, Agent, or Firm*—Morton J. Rosenberg; David I. Klein

[57] ABSTRACT

An automatic back brushing massager has three brushes fixed on three planet gears. The three plant gears are positioned between a sun gear and an epicyclic gear and engage the sun and epicyclic gear in order to rotate synchroneously. The epicyclic gear also has a worm gear on an outer circumferential edge to engage a worm driven by a motor via a pair of bevel gears. The three brushes are then doubly rotated by said motor for brushing and massaging a person's back at the same time. This brushing and massaging is aided by the elasticity of coil springs set between brushes and the planet gears.

4 Claims, 5 Drawing Sheets

AUTOMATIC MASSAGER

BACKGROUND OF THE INVENTION

This invention concerns an automatic back brushing massager.

SUMMARY OF THE INVENTION

This invention has been devised to offer an automatic back brushing massager to be used in a bathroom for automatically brushing and massaging a person's back same time.

The automatic back brushing massager in the present invention is fixed on the wall of a bathroom and its height is adjustable to suit the height of a user by means of a slide block fitting in a hanger. The massager has three brushes fixed with three planet gears engaging a sun gear and a epicyclic gear. The epicyclic gear has a worm gear on its outer circumferential edge which engages a worm driven by a motor. The three brushes rotate themselves and around the sun gear at the same time to brush and massage a person's back.

This massager has been planned to have advantageous features as follows.

1. Double rotation of the brushes for washing and brushing a person's back with some convenient elasticity coming from coil springs.

2. The motor can be adjusted in its speed by a switch arranged on a panel on an outer surface of the massager.

3. The brushes can be double rotated by a rope pulled right and left manually without using the motor.

BRIEF DESCRIPTION OF DRAWINGS

The invention will be better understood by reference to the accompanying drawings, wherein.

DESCRIPTION OF THE PREFERRED EMBODIMENTS

Figure 2:
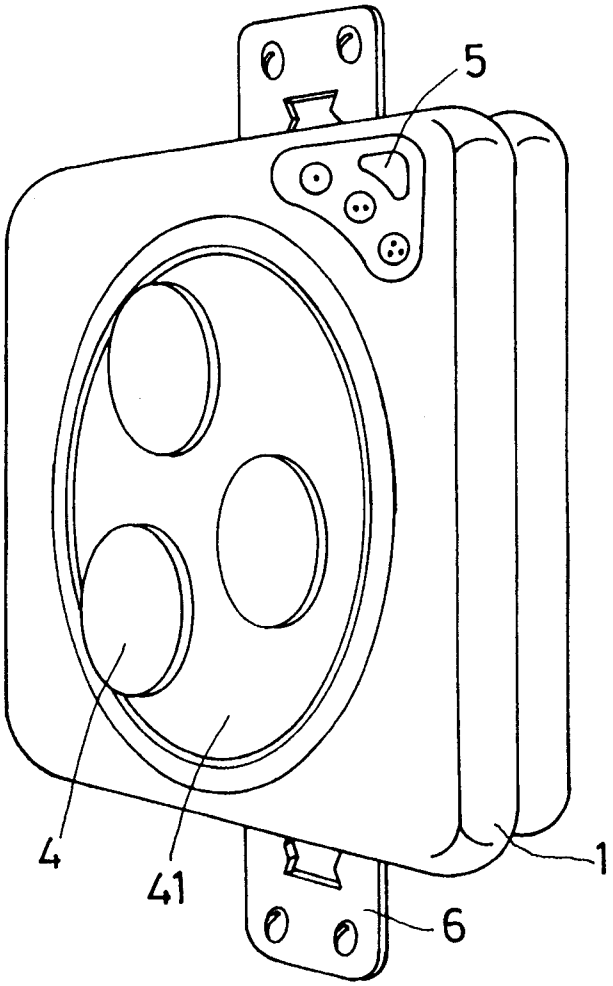
FIG. 2 is a perspective view of an outer look of the automatic massager in the present invention.
Figure 1:
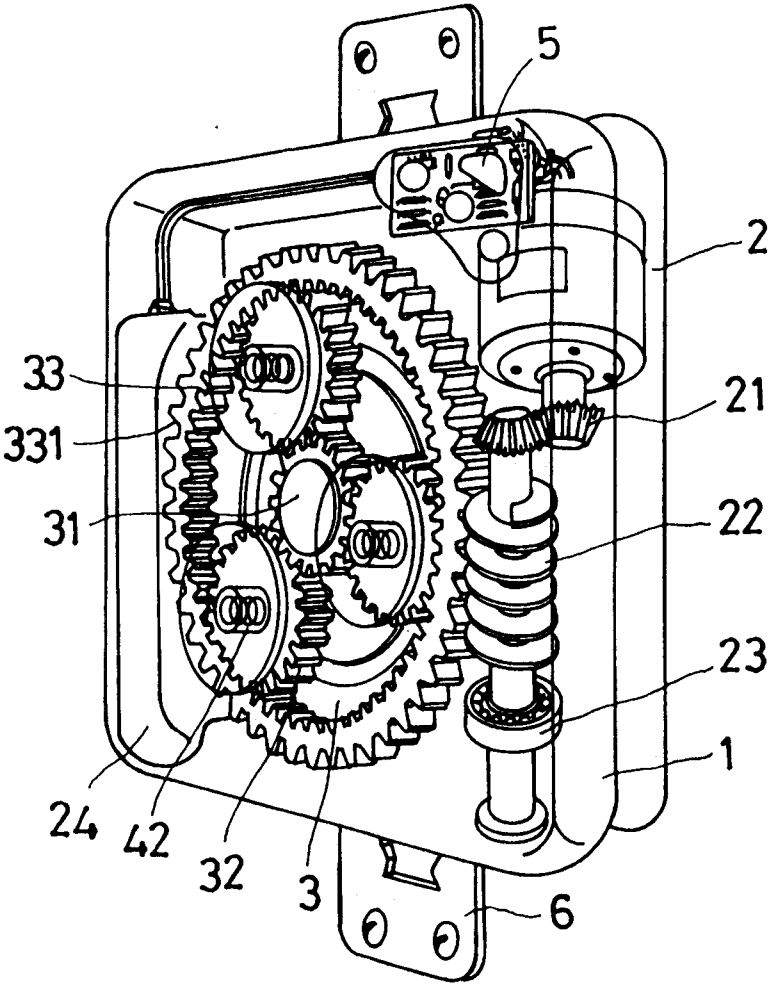
FIG. 1 is a perspective view of an inner structure of an automatic massager in the present invention.

An automatic massager in the present invention, as shown in FIGS. 1 and 2, includes a housing 1, a motor 2, a sun and planet gear unit 3, a plurality of brushes 4, a switch panel 5 and a hanger 6 as the main components.

The housing 1 is shaped as a case for containing the other components, the motor 2, the sun and planet gear units 3, a worm 22 and a battery. The switch panel 5 is fixed on an upper corner of an outer surface thereof.

The motor 2 has its shaft fixed with a bevel gear 21 engaging another bevel gear 21 fixed on an end of the worm 22, which is pivotally connected with the housing 1. A battery chamber 24 is provided in the housing

1 to place a battery for supplying electric power to the motor 2 or an external electric power source can be connected with the motor 2.

The sun and planet gear unit 3 includes a sun gear 31, three planet gears 32, and an epicyclic gear 33 combined together. The sun gear 31 is fixed on a bottom wall of the housing 1, and the three planet gears 32 are deposited between the sun gear 31 and the epicyclic gear 33 and engaged and rotate one another. The epicyclic gear 33 has a worm gear on its outer circumferential edge to engage a worm 22 vertically fixed beside the epicyclic gear 33 so that the epicyclic gear 33 can be rotated by the worm 22 when the motor 2 is electrified.

Then a disc cover 41 is pivotally combined with the planet gears 32 and three brushes 4 are fixed on the planet gears 32 with coil springs 42 to rotate together with the three planet gears 32.

Figure 4:
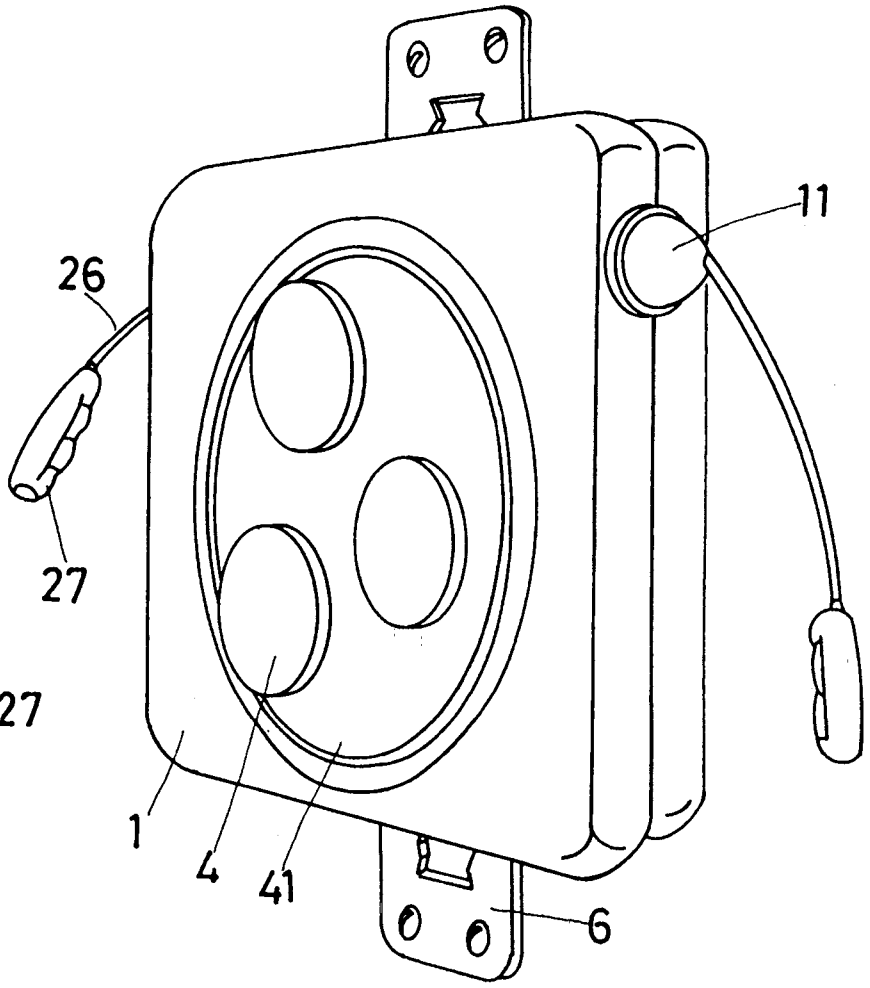
FIG. 4 is a perspective view of an outer look of the manual massager in the present invention.
Figure 3:
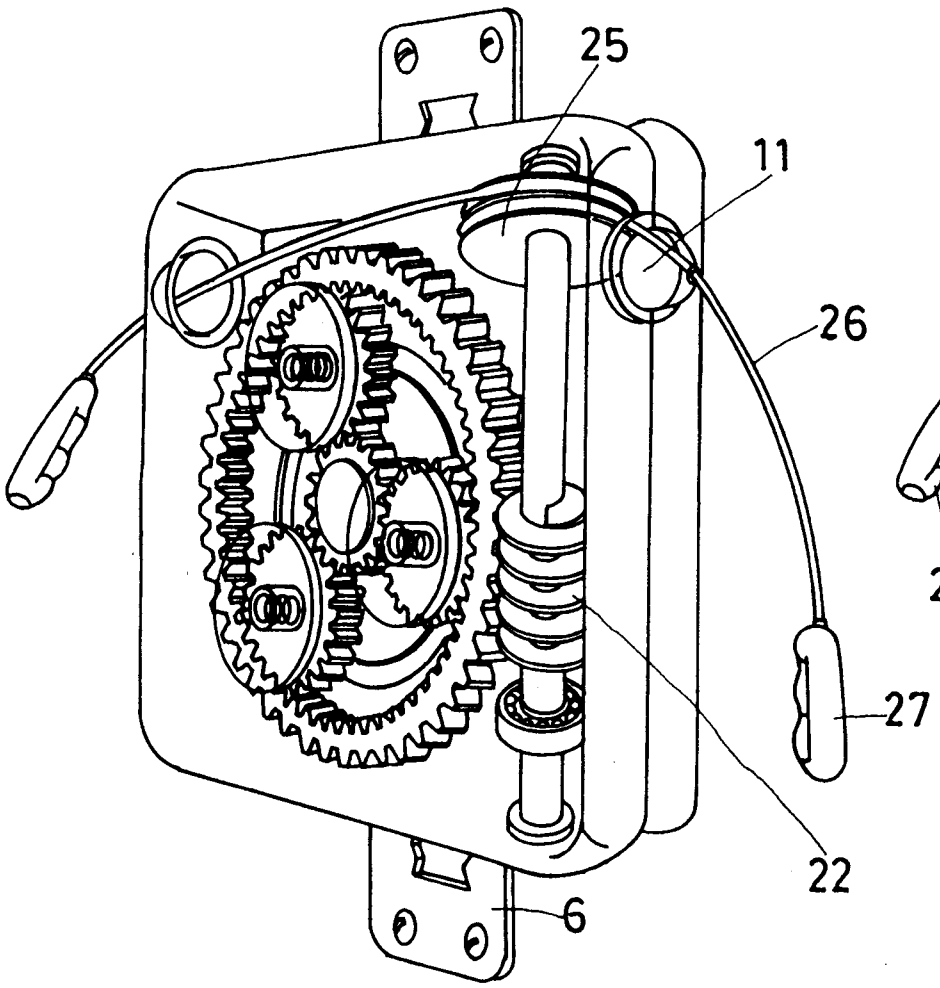
FIG. 3 is a perspective view of an inner structure of a manual massager in the present invention.

The automatic massager described above can be turned into a manual massager, as shown in FIGS. 3 and 4, by removing the motor 32 and the pair of bevel gears 21, 21 and lengthening the worm 22 to be pivotally connected with an upper side wall of the housing 1 and combining a rotating wheel 25 on the end portion of the worm 22, and a rope 26 wound around the rotating wheel 25 with two grips 27, 27 fixed on both ends of the rope 26. Two cone-shaped cups 11, 11 are fixed on two opposite side walls of the housing i for guiding the rope 26 to extend out of the housing 1.

In use, the motor 2 is started, or the rotating wheel 25 is rotated by the pulling rope 26 with hands on the grips 27, 27. The worm 22 is rotated to turn the epicyclic gear 33, which then rotates the planet gears 32 and then the cover disc 41. Consequently the brushes 4 turn not only around with the cover disc 41, but also turns themselves, so that when a user moves near the massager, and the user's back is contacting the brushes 4, the double rotation of the brushes 4 can function as a massager on the user's back with help of the coil springs 42.

Figure 6:
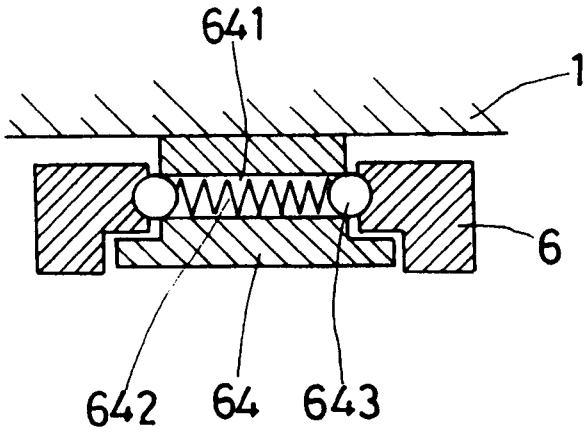
FIG. 6 is a cross-sectional view of the vertical location adjuster in the present invention.
Figure 5:
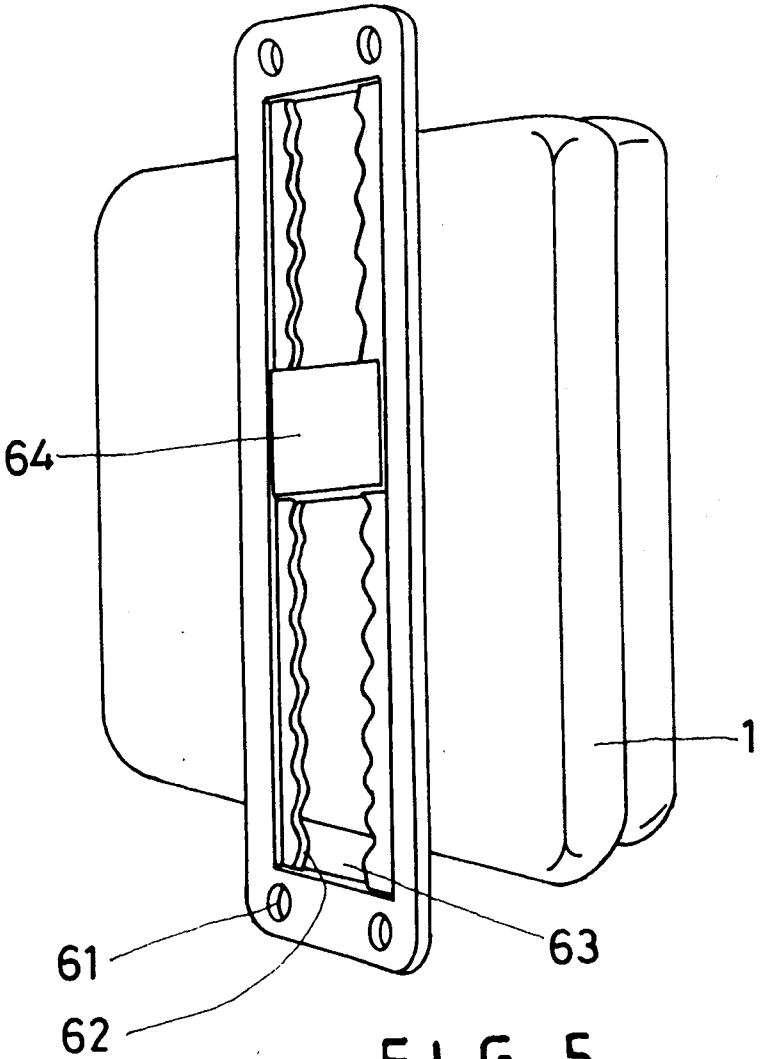
FIG. 5 is a perspective view of a vertical location adjuster for the automatic or the manual massager in the present invention.
Figure 7:
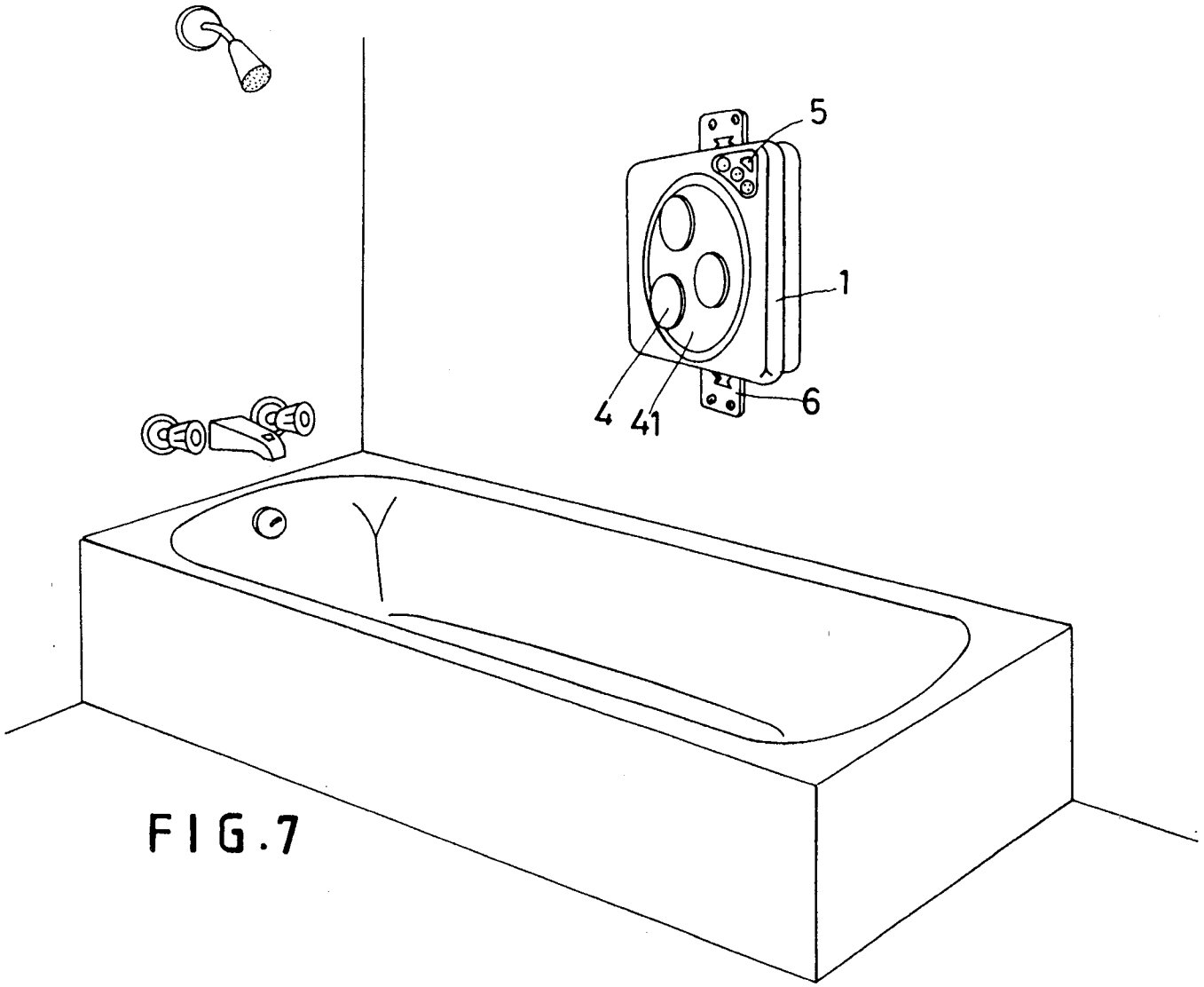
FIG. 7 is a perspective view of the automatic massager in the present invention fixed on a wall of a bathroom; and, FIG. 8 is a perspective of the manual massager in the present invention fixed on a wall of a bathroom.
Figure 8:
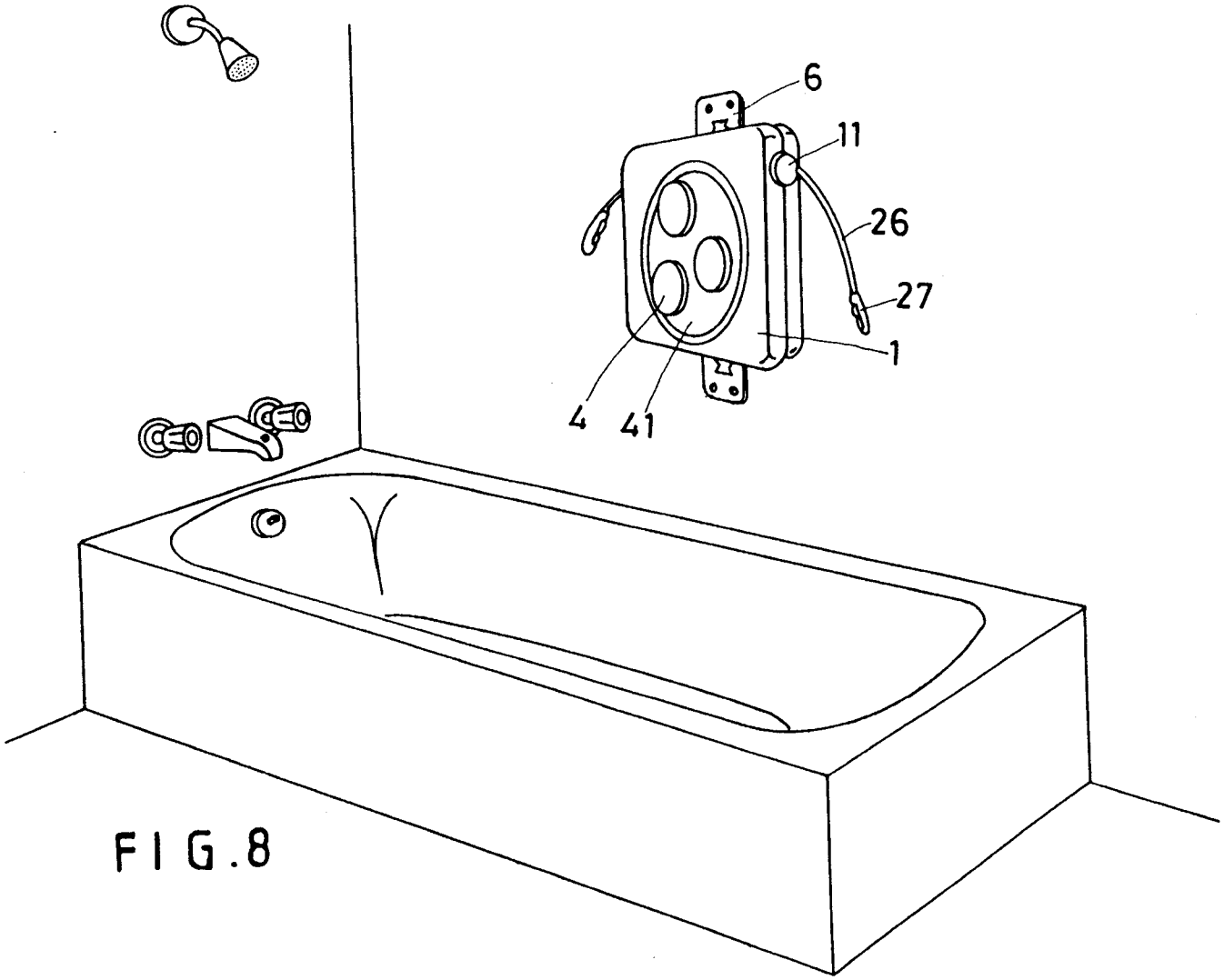

FIGS. 5 and 6 show the hanger 6 used for fixing this massager on a wall and the height of the position hangers 5 pulled to protrude out of one end of the recess 22 of the bottom base 2 and with the locating hole 52 hung on a nail, a screw or a section disc 8, as shown in FIGS. 7 and 8.

While the preferred embodiments of the invention have been described above, it will be recognized and understood that various modifications may be made therein and the appended claims are intended to cover all such modifications which may fall within the spirit and scope of the invention.

What is claimed is:

1. An automatic massager comprising:

(a) A housing defining an internal chamber;

(b) A worm gear rotatably mounted to a wall of said housing and located within said internal chamber;

(c) planet gear means located within said housing for responsive rotation to the rotation of said worm gear, said planet gear means including a central sun gear in meshing drive contact with three planet gears and an epicyclic gear having internal and external teeth, said epicyclic gear internal teeth in meshing engagement with said sun gear and said epicyclic external teeth in meshing engagement with said worm gear, said planet gears positionally located between said sun gear and said epicyclic gear for simultaneous rotation of said planet gears, said sun gear, and said epicyclic gear;

(d) a plurality of brushes, each of said brushes mounted on a disc cover, said covers being coupled to each of said planet gears by a respective coil spring for resilient coupling of said brushes to said planet gears;

(e) a massager hanger of substantially planar and rectangular contour having a plurality of screw through openings for insertion therethrough of respective screws for fixedly coupling said massager hanger to a wall, said massager hanger having a longitudinally directed through slot having opposing toothed edge sidewalls forming said through slot, a slide block secured to a rear wall of said housing and slidingly engaging through slot toothed edge sidewalls; and, (f) means for rotatively driving said worm gear to responsively rotate said epicyclic gear, said planet gears, and said sun gear for massaging a user's body by said brushes.

2. The automatic massager as recited in claim 1 where said means for rotatively driving said worm gear includes a motor having a motor bevel gear coupled to one end of a motor shaft for meshing engagement with a worm bevel gear mounted to an end of worm gear.

3. The automatic massager as recited in claim 1 where said means for rotatively driving said worm gear includes a pulley member fixedly secured to one end of said worm gear, said worm gear and said pulley member having a coincident axis of rotation and a pull rope wound around said pulley member and extending external said housing through a pair of cup members secured to said housing on opposing sidewalls of said housing, said pull rope having a pair of hand grip members secured to opposing ends thereof for manual rotative actuation of said pulley member, said worm gear, said epicyclic gear, said planet gears, said sun gear and said brush members.

4. The automatic massager as recited in claim 1 where said slide block includes a laterally directed through opening having a slide block coil spring therein for urging a pair of ball members mounted on opposing ends of said slide block coil spring into engagement with opposing respective tooth grooves formed by said toothed edge sidewalls whereby said slide block and said housing may be longitudinally displaced within said hanger through slot for adjustment of the positional location of said automatic massager.

* * * * *